US005169564A

United States Patent [19]

Gallacher et al.

[11] Patent Number: 5,169,564

[45] Date of Patent: * Dec. 8, 1992

[54] THERMOOXIDATIVELY STABLE COMPOSITIONS

[75] Inventors: Lawrence V. Gallacher, Norwalk, Conn.; Alfen J. Gustavsen, Ballwin, Mo.; Robert L. Kugel, Norwalk, Conn.

[73] Assignee: King Industries, Inc., Norwalk, Conn.

[ * ] Notice: The portion of the term of this patent subsequent to Jan. 23, 2007 has been disclaimed.

[21] Appl. No.: 341,516

[22] Filed: Apr. 21, 1989

Related U.S. Application Data

[63] Continuation-in-part of Ser. No. 26,077, Mar. 16, 1987, Pat. No. 4,895,674.

[51] Int. Cl.[5] ..... C09K 15/00

[52] U.S. Cl. ..... 252/400.52; 252/402; 252/404; 252/400.62; 252/380; 252/33.2

[58] Field of Search ..... 25/18; 524/423; 252/402, 404, 387, 389.52, 389.62, 400.52, 75, 33.2, 33.3, 400.62, 380, 33.2; 106/14.23, 14.36, 14.28

[56] References Cited

U.S. PATENT DOCUMENTS

| | | | |
|---|---|---|---|
| 2,813,829 | 11/1957 | Bollinger | 252/401 |
| 2,840,477 | 6/1958 | Shocke et al. | 106/14 L8 |
| 2,856,362 | 10/1958 | Morway | 252/33.3 X |
| 2,968,630 | 1/1961 | Pillon | 252/405 |
| 3,090,750 | 5/1963 | Bergen et al. | 252/33.3 X |
| 3,265,855 | 11/1966 | Dexter et al. | 252/57 |
| 3,285,855 | 11/1966 | Spivack et al. | 252/48.6 |
| 3,438,935 | 4/1969 | Leu | 252/405 |
| 3,623,983 | 11/1971 | Pattenden et al. | 252/33.4 |
| 3,625,894 | 12/1971 | Koenig et al. | 252/33.4 |
| 3,629,109 | 12/1971 | Gergel | 252/33.2 X |
| 3,671,430 | 6/1972 | Corringer | 252/33.3 X |
| 3,684,726 | 9/1972 | Haak et al. | 252/33.2 |
| 3,763,042 | 10/1973 | Gannon et al. | 252/21 |
| 3,772,197 | 11/1973 | Milsom | 252/33.2 |
| 3,836,467 | 9/1974 | Jones | 252/18 |
| 4,125,479 | 11/1978 | Chesluk et al. | 252/336 |
| 4,134,843 | 1/1979 | Rebuck et al. | 252/401 |
| 4,165,291 | 8/1979 | Gragson | 252/18 |
| 4,201,681 | 5/1980 | Lipinski et al. | 252/33.2 |
| 4,213,892 | 7/1980 | Scott | 260/45.95 C |
| 4,242,224 | 12/1980 | Dean, II et al. | 252/401 |
| 4,261,840 | 4/1981 | Gragson | 252/18 |
| 4,280,894 | 7/1981 | Taylor | 252/401 |
| 4,326,972 | 4/1982 | Chamberlin, III | 252/33.3 |
| 4,354,007 | 10/1982 | Scott | 525/370 |
| 4,419,251 | 12/1983 | Shim | 252/33.3 X |
| 4,419,252 | 12/1983 | Shim | 252/33.3 X |
| 4,430,468 | 2/1984 | Schumacher et al. | 524/423 |
| 4,434,258 | 2/1984 | Schumacher et al. | 524/423 |
| 4,592,851 | 6/1986 | Stadtmiller et al. | 252/32.7 E |
| 4,769,162 | 9/1988 | Remus | 252/18 |
| 4,836,943 | 6/1989 | Kapuscinski et al. | 252/405 |

FOREIGN PATENT DOCUMENTS

| | | |
|---|---|---|
| 471259 | 2/1949 | Belgium . |
| 0295108 | 12/1988 | European Pat. Off. . |
| 50034003 | 7/1973 | Japan . |
| 53-075137 | 4/1978 | Japan . |

OTHER PUBLICATIONS

Chemical Abstracts, vol. 85, No. 4, Aug. 23, 1976, p. 151 Abstract No. 49156z, Institute of the Petrochemical and Gas Industry.

Chemical Abstracts, vol. 88, No. 2, Sep. 1, 1978, p. 147 Abstract No. 9571m, G. V. Barabanova.

Nose, et al., Chemical Abstract, 79(26), 147965h, "Oil Rustproofing Compositions," 1973, p. 82.

*Primary Examiner*—Robert L. Stoll
*Assistant Examiner*—Valerie Fee
*Attorney, Agent, or Firm*—Hedman, Gibson & Costigan

[57] ABSTRACT

A composition which is thermooxidatively stable is provided which comprises a normally thermooxidatively unstable organic compound and effective amount of a thermooxidative stabilizing composition comprising an oil soluble sulfonate of a metal selected from barium, calcium, magnesium, zinc or a mixture of any of the foregoing; an effective amount of at least one primary antioxidant; optionally an effective amount of a secondary antioxidant; and optionally a carrier for the thermooxidative stabilizing composition. A thermooxidative stabilizing composition and a method for stabilizing a normally unstable organic compound comprising the addition of an effective amount of the thermooxidative stabilizing composition are provided as well.

13 Claims, No Drawings

THERMOOXIDATIVELY STABLE COMPOSITIONS

CROSS-REFERENCE TO RELATED APPLICATIONS

This application is a continuation-in-part of copending U.S. patent application Ser. No. 07/026,077, filed on Mar. 16, 1987, now U.S. Pat. No. 4,895,674. This application is also related to concurrently filed, copending U.S. patent application Ser. No. 07/341,516 now U.S. Pat. No. 5,133,900.

FIELD OF THE INVENTION

This invention relates to thermooxidatively stable sulfonate containing compositions. More particularly, it concerned with the thermooxidative stabilization of normally thermooxidatively unstable organic compounds including both natural and synthetic media

BACKGROUND OF THE INVENTION

Alkali metal and alkaline earth metal salts of high molecular weight alkaryl and petroleum sulfonic acids have long been widely used as dispersants and rust or corrosion inhibitors in a number of applications such as in lubricating oils, greases and rust-preventative coatings.

It has been reported that alkali metal and alkaline earth metal sulfonates can be combined with carboxylic acids, esters or soaps to enhance corrosion and oxidation inhibiting properties, e.g., U.S. Pat. Nos. 3,090,750; 3,625,894; 3,684,726; 3,763,042; 4,209,081; and Japanese Patent Publication 48/12238.

Bergen et al, U.S. Pat. No. 3,090,750, disclose greases which reform spontaneously upon cooling comprising an oil-insoluble metal compound, a dispersing agent selected from oil-soluble sulfonic acid or derivatives thereof or oil soluble carboxylic acids or derivatives thereof, and a lubricating and an acid coupling agent. Thermooxidative stability is not shown to be enhanced and synergism with antioxidants is not suggested.

In U.S. Pat. No. 3,625,894, Koenig et al. describe lubricating compositions combined with an anticorrosive consisting of an alkaline earth metal petroleum sulfonate and/or an oil-soluble alkaline earth metal salt of a $C_{10}$–$C_{36}$ fatty acid and/or an oil-soluble alkaline earth metal salt of an alkylsulfamido-carboxylic acid, and benzotriazol. Although the compositions disclosed in the '894 patent are said to provide protection against corrosion for lubricants and mineral oils that have to withstand extreme temperatures, e.g., turbine oils, up to 170° C., only a temperature of 100° C. for 100 hours is exemplified. Furthermore, the use of primary antioxidants to provide synergism is not suggested.

Haak et al., U.S. Pat. No. 3,684,726 teach the inclusion of synergistic mixtures of barium alkaryl sulfonates and a naphthenate salt of zinc, lead, lithium or magnesium to improve the anti-corrosion properties of lubricating greases comprised of a metal soap and mineral oil. There is no disclosure in this patent however, that the thermoxidative stability of such greases is enhanced.

Gannon et al., U.S. Pat. No. 3,763,042 describe clay-thickened greases containing synergistic proportions of zinc dialkylnaphthalene sulfonate, an ester of an aliphatic monohydric alcohol and an aliphatic $C_{12}$–$C_{24}$ monocarboxylic acid, zinc naphthenate, and other additives including certain other oxidation inhibitors. However, there is no exemplification of the combination with any oxidation inhibitors.

In U.S. Pat. No. 4,201,681, Lipinski et al. disclose a metal-working lubricant composition comprising a mineral oil and an additive combination of barium lanolate soap and barium sulfonate, e.g., barium didodecyl benzene sulfonate. The composition of Lipinski et al. are tested for a number of characteristics, e.g., corrosion, stain and drawing properties, stack test for stain and friction measurements, visual observation for galling and scoring; however no enhances stability to thermoxidation was investigated or demonstrated.

In Japanese Patent Publication No. 48/12238, published Feb. 15, 1973, as abstracted in CA 70(26): 147965h, there are disclosed rustproofing oil compositions obtained by combining zinc soap of wool fatty acid and barium sulfonate to mineral oil. Improved rustproofing properties and moisture- and weathering-resistances are reported but no reference is made to rustproofing compositions having enhanced thermooxidative stability.

Stadtmiller et al, U.S. Pat. No. 4,592,851, disclose the use of a combination of a basic zinc dialkyl dithiophosphate and 2,6 di-t-butyl phenol to stabilize paraffinic mineral oil lubricants.

Dexter et al, U.S. Pat. No. 3,265,855, disclose the use of esters of hindered hydroxybenzoic and hydroxyphenyl alkanoic acids as stabilizers for organic materials subject to oxidative deterioration, and Scott, U.S. Pat. Nos. 4,213,892 and 4,354,007, discloses antioxidants as stabilizers for polymers, but neither suggest to combine these stabilizers with sulfonates.

It has now been unexpectedly discovered that the thermooxidative stability of normally thermooxidatively unstable organic compounds is remarkably and dramatically improved by the incorporation of a thermooxidative stabilizing composition comprising an oil-soluble barium, calcium, magnesium or zinc sulfonate; a primary antioxidant; optionally, a secondary antioxidant; and optionally a carrier for the thermooxidative stabilizing composition. When incorporated into normally thermooxidatively unstable organic compounds, oxidative degradation as well as deterioration caused by thermal effects are inhibited by the synergistic effect of the thermooxidative stabilizer composition or package components to a greater degree than is recognized in compositions of the prior art including those stabilized by a primary antioxidant and/or secondary antioxidants alone or oil soluble metal sulfonates alone.

It is a further object of this invention to provide a method for stabilizing a normally thermooxidatively unstable organic compound by blending the unstable compound and an effective amount of the thermooxidative stabilizing composition above.

This invention also contemplates thermooxidation stabilizer packages comprising only the thermooxidative stabilizer composition from above for use in the stabilization of normally thermooxidatively unstable organic compounds.

SUMMARY OF THE INVENTION

According to the present invention, there are provided thermooxidatively stabilized compositions comprising (A) a normally thermooxidatively unstable organic compound; and an effective amount of (B) a thermooxidative stabilizing composition comprising (i) an oil-soluble sulfonate of a metal selected from barium, calcium, magnesium, zinc or a mixture of any of the foregoing; (ii) an effective amount of at least one primary antioxidant; optionally, (iii) an effective amount of a secondary antioxidant; and optionally, (iv) a carrier for the thermooxidative stabilizing composition.

The invention also provides a method for stabilizing a normally thermooxidatively unstable organic compound comprising blending with the compound, an effective amount of the thermooxidative stabilizing composition (B) from above.

Also contemplated by the invention are thermooxidative stabilizer compositions or packages comprising only component (B) from above.

DESCRIPTION OF THE INVENTION

Normally thermooxidatively unstable organic compounds which are used in the present invention include naturally occurring and synthetic organic compounds. These include, but not limited to, petroleum products, lubricating oils of the aliphatic ester type, e.g., dihexyl azelate, di-(2-ethylhexyl)azelate, di-(3,5,5-trimethylhexyl)glutarate, diisoamyl adipate, pentacrythritol tetracaproate, triamyl tricarballate, dipropylene glycol dipelargonate, 1,5-pentanediol di-(2-ethylhexanoate), and the like; animal and vegetable derived oils, e.g., linseed oil, fat, tallow, lard, peanut oil, cod liver oil, castor oil, palm oil, corn oil, cotton seed oil and the like; hydrocarbon material such as gasoline, both natural and synthetic, diesel oil, mineral oil, fuel oil, naphthenic oil, drying oil, cutting fluids, waxes, resins and the like, fatty acids such as soaps; trimethylolpropane tripelargonate, EPT rubber, chlorinated rubber, natural rubber and the like.

Other materials thermooxidatively stabilized according to the present invention include cross-linked and thermoplastic resins having linear, branched and/or ring hydrocarbon sequences in the backbone or the side chain, and optionally substituted with, for example, oxygen, nitrogen and/or phosphorous; thermosetting polymers and various synthetic organic polymeric substances such as vinyl resins formed from the polymerization of vinyl halides or from the copolymerization of vinyl halides with unsaturated polymerizable compounds, e.g., vinyl esters, alpha,beta-unsaturated acids, alpha,beta-unsaturated esters, alpha,beta-unsaturated ketones, alpha,beta-unsaturated aldehydes and unsaturated hydrocarbons such as butadienes ano styrene; poly-alpha-olefins such as polyethylene, polypropylene, polybutylene, polyisoprene and the like, including copolymers of poly-alpha-olefins, polyurethanes such as are prepared from polyols and organic polyisocyanates; polyamides such as polyhexamethylene adipamide; polyesters such as polymethylene terephthalates and polybutylene terephthalates; polycarbonates; polyacetals; polystyrene; polyethyleneoxide; and copolymers such as those of high impact polystyrene containing copolymers of butadiene and styrene and those formed by the copolymerization of acrylonitrile, butadiene and/or styrene.

The barium, calcium, magnesium or zinc metal sulfonates useful as component (B)(i) in the practice of this invention include a wide variety of compounds known to those skilled in the art. The alkaryl or polyalkaryl sulfonates may be prepared by following the teachings of U.S. Pat. Nos. 2,764,548, 3,957,859, and 4,201,681.

Aromatic organic substrates, such as aromatic petroleum fractions, as well as benzene and its analogs, e.g., alkylbenzenes, toluene, the xylenes, polyalkylbenzenes, and higher alkyl mono- and di- and polysubstituted benzenes, such as nonyl and decyl and dodecyl, straight and branched chain-substituted benzenes and the corresponding naphthalenes, form sulfonates which are preferentially oil soluble (selectively extractable with organic hydrocarbon solvents, and the like), and sulfonates which are preferentially water soluble (and alcohol soluble, being selectively extractable with water and alcohols, and the like).

As is the case in U.S. Pat. No. 2,764,548, it is preferred to use a dinonylnaphthalene, the nonyl radicals of which are highly branched, and to use as a reaction solvent, a water-immiscible material selected from naphtha, hexane, heptane, octane, chlorinated hydrocarbons and the like. Procedures to make the starting materials are thoroughly described in the '548 patent.

Methods for forming aromatic mono- and disulfonic acids, e.g., dinonylnaphthalene mono- and polysulfonic acids are well described in the aforementioned U.S. Pat. No. 3,957,859. Typically, these alkyl or polyalkylaryl sulfonic acids will have molecular weights in the range of greater than 150–2,500 or greater, preferably 200 or greater, most preferably 325 or greater. Suitable sulfonates are those having an alkaryl group, e.g., alkylated benzene or alkylated naphthalene. Illustrative examples of such sulfonic acids are dioctyl benzene sulfonic acid, didodecyl benzene sulfonic acid, dinonyl naphthalene sulfonic acid, dilauryl benzene sulfonic acid, lauryl cetyl benzene sulfonic acid, polyolefin alkylated benzene sulfonic acids such as polybutylene alkylated benzene sulfonic acid and polypropylene alkylated benzene sulfonic acid. Especially preferred as aromatic sulfonates in the practice of this invention are dinonylnapthalene sulfonates, nonylnaphthalene sulfonates, petroleum sulfonates, dodecenylbenzene sulfonates, and the like.

The metal salt or sulfonate salt (B)(i) is a salt of barium, calcium, magnesium, zinc or a mixture of any of the foregoing. The metal sulfonates of component (B)(i) may be formed by conventional methods known to those skilled in the art. The metal salts of aromatic sulfonic acids may be prepared by reacting an inorganic metal donor compound, e.g., metal hydroxide, metal oxide or metal carbonate with the alkyl or dialkyl or polyalkyl aromatic sulfonic acid. Thus, for example, the reaction of any of barium hydroxide, calcium oxide, magnesium oxide, zinc hydroxide, and the like with the corresponding alkaryl sulfonic acid will yield suitable metal sulfonates. Suitable as component (B)(i) are barium, calcium, magnesium or zinc sulfonates such as barium dinonylnaphthalene sulfonate; calcium dinonylnaphthalene sulfonate; magnesium dinonylnaphthalene sulfonate; zinc dinonylnaphthalene sulfonate; barium alkylbenzene sulfonate, particularly barium dodecenylbenzene sulfonate; calcium alkylbenzene sulfonate, particularly calcium dodecenylbenzene sulfonate; magnesium alkylbenzene sulfonate, particularly magnesium dodecenylbenzene sulfonate; zinc alkylbenzene sulfonate, particularly zinc dodecenylbenzene sulfonate; or a mixture of any of these. Especially preferred are barium dinonylnaphthalene sulfonate, calcium dinonylnapthalene sulfonate, magnesium dinonylnaphthalene sulfonate, and zinc dinonylnaphthalene sulfonate which are available under the respective tradenames NA-SUL® BSN, NA-SUL® CA, NA-SUL® MG, and NA-SUL® ZS, King Industries.

The primary antioxidants (B)(ii) of the present invention can be at least one phenolic antioxidant, at least one aromatic amine antioxidant, or a combination of any of the foregoing. Monophenols, bisphenols, thiobisphenols and polyphenols are all suitable phenolic antioxidants. Preferably, the phenolic antioxidant will comprise a hindered phenolic antioxidant, esters thereof including those disclosed in Dexter et al., U.S. Pat. No. 3,285,855, or a combination of any of the foregoing. Examples of suitable primary antioxidants are methylene bis-4,4'-2,6-di-t-butyl phenol, 4,4'-dioctyldiphenylamine, alkylated phenyl-alpha-naphthylamines, t-butyl phenol derivatives, alkylated diphenylamines, phenyl-alphanaphthylamine, sulfur containing hindered bisphenols, or a mixture of any of the foregoing.

The synergistic effect of components (B)(i) and (B)(ii) may optionally be enhanced by the additional synergism of an effective amount of a secondary antioxidant (B)(iii) with components (B)(i) and (B)(ii). Such secondary antioxidant will typically comprise a thiocarbamate, a thioester, or a combination of any of the foregoing and preferably will comprise zinc diamylthiocarbamate

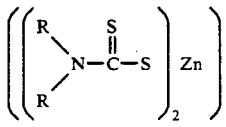

wherein R is $C_5H_{11}$;
or zinc diabutylthiocarbamate

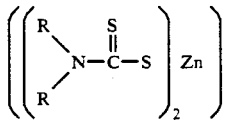

wherein R is $C_4H_9$.

Typically, the optional carriers (B)(iv) can comprise a synthetic hydrocarbon base fluid such as a polyalphaolefin or a mixture of polyalphaolefins, mineral oil, a wax, an ester, a halocarbon fluid, polyglycol, mixtures of any of the foregoing and the like. Preferred as carrier (B)(iv) are crystalline wax, mineral spirits, or kerosene. Especially preferred as carrier (B)(iv) are light mineral oil, polyalphaolefins or mixtures thereof.

The mineral oils useful in the composition of this invention as carriers will generally have a viscosity of at least about 30 SUS up to about 600 SUS at 100° F. (37.7° C.). More particularly the mineral oils will have a viscosity of from about 40 SUS to about 350 SUS at 100° F. (37.7° C.) and preferably from about 50 to about 150 SUS at 100° F. (37.7° C.). The term light mineral oil generally is accepted to mean an oil with a viscosity of less than about 150 SUS at 100° F.

The mineral oils can vary widely in refinement, and they can be derived from a variety of crudes including paraffinic, naphthenic, asphaltic or mixed base. The mineral oils can be treated by any of the conventional refining methods including hydrogen treating, acid treating, extraction, etc., and blends or mixtures of such mineral oils can also be used.

Preferably, component (A) will comprise from about 95 to about 99.95 percent by weight and component (B) will comprise from about 5 to about 0.05 percent by weight of (A) and (B) combined.

Preferably, component (B)(i) will comprise from about 2 to about 20 percent by weight; component (B)(ii) will comprise from about 40 to about 90 percent by weight; component (B)(iii) will comprise from zero to about 50 percent by weight; and component (B)(iv) will comprise from zero to about 30 percent by weight of (B)(i), (B)(ii), (B)(iii) and (B)(iv) combined.

Thermooxidative stability includes protection against thermal degeneration and oxidative degeneration.

The composition of the present invention can be employed in a number of applications including but not limited use, as compressor oils, engine oils, gear oils, hydraulic fluids, rust preventives, slushing oils, synthetic lubricants and turbine oils. In short, these compositions can be employed in any application requiring thermooxidative stability. These compositions are particularly useful in high temperature applications e.g., greater than 150° C., especially greater than 180° C., and even greater than 200° C. for prolonged periods of time. Many of these compositions also exhibit enhanced rust and corrosion inhibiting properties.

A method of stabilizing normally thermooxidatively unstable organic compounds is also provided which comprises blending by any conventional means known to one of ordinary skill in the art such as mixing, stirring, dispersing, and the like, with the normally thermooxidatively unstable organic compound, an effective amount of the thermooxidative stabilizing composition or package (B) from above.

DESCRIPTION OF THE PREFERRED EMBODIMENTS

The following examples illustrate the invention without limitation. All parts and percentages are given by weight unless otherwise indicated. Induction period is the period of protection afforded against oxidation and/or increase in acid value.

Thermooxidative stability is reflected by change in acid value (mg KOH/g), color, length of induction period, change in viscosity, or a combination of any of the foregoing.

ASTM Test Method D4636-86 (a combination of Federal Test Methods 5307.1 and 5308.6) and a modified version of the IP48 test are incorporated in many of the examples below.

ASTM Test Method D4636-86 is conducted as follows:

200 ml of test sample are weighed into a large glass tube (cell) having an outside diameter of 51 mm and a length of approximately 350 mm exclusive of a large ground glass joint designed to accept an adapter head. The head, approximately 100 mm in height, contains standard taper ground glass joints for a reflux condenser, a thermowell and an O ring compression fit joint for accepting an air delivery tube. The thermowell is made of 5 mm OD glass tubing, is approximately 425 mm long, and comes to within 35 mm of the bottom of the tube. The temperature of the sample is monitored using a type J thermocouple attached to a remote thermometer. The air delivery tube is made of 6 mm OD glass tubing, is approximately 535 mm in length and is inserted to within 5 mm of the bottom of the tube. A flange is placed approximately 15 mm from the bottom of the air tube and on this flange are stacked in order, from the bottom, washer shaped specimens of aluminum alloy, silver, silicon-iron bronze, steel grade 1010, steel M50, magnesium, and titanium 8 percent manganese. The washers are 6.35 mm insider diameter by 19.05 mm outside diameter by 0.81 mm thick and are polished with 400 grit silicon carbide paper before use. Glass spacers, 9 mm OD and 6 mm in length, are used to separate the washers. Dry air is passed through the sample at 10±1 liters/hour.

The sample cells are immersed in high temperature silicone fluid, thermostatically heated in a Sta-Warm heating bath. Samples are removed through the thermowell joint in the head through a U shaped tube approximately 600 mm long, to reach to the bottom of the main sample tube.

The modified IP48 test is conducted as follows:

36 grams of test sample are weighed into a large glass tube having an outside diameter of 38 mm and a length of approximately 200 mm exclusive of a standard taper ground glass joint at the top. An adapter containing a gas inlet tube, 8 mm OD, reaching to the bottom is inserted into the large glass tube, and a reflux condenser is fitted to the top. Lengths of copper and iron catalyst, each approximately 460 mm long, are braided around the gas inlet tube to form a tight coil approximately 50 mm long. The catalyst coil is activated by rinsing with heptane, air drying and immersing for one minute in a 15v/v% solution of concentrated hydrochloric acid in acetone. After rinsing with water and then acetone, the coil is air dried.

The tube is immersed in a heating bath for 15 minutes and zero grade air is passed through the sample at 15 liters/hour.

PROCEDURE A

A 1000 ml flask with a heating mantle, stirrer condenser and thermometer is charged with 390 grams of a 39 percent solution of dinonylnaphthalene sulfonic acid in heptane, 14.2 grams of zinc oxide and 216 grams of a 4 cSt synthetic hydrocarbon base fluid (polyalphaolefin mixture - Emery® 3004 PAO - Quantum Chemical Corp. Cincinnati, OH - Baton Rouge - La.). The contents of the flask are heated to reflux temperature and are held for four hours with stirring to react the zinc oxide with the sulfonic acid to form the zinc salt of the sulfonic acid. The stirred reaction mixture is then heated to 150° C. at atmospheric pressure to strip the heptane, then cooled to below 100° C., and then stripped under vacuum to yield 214 grams of reaction product. The reaction product is analyzed by hyamine titration and is found to contain 40.95 percent zinc sulfonate. The reaction product (NA-SUL® ZS - King Industries - Norwalk, Conn.) is a clear viscous brown liquid.

PROCEDURE B

A 12,000 ml flask with a heating mantle, stirrer, condenser and thermometer is charged with 27,066 grams of a 38.41 percent solution of dinonylnaphthalene sulfonic acid in heptane and 478 grams of low density magnesium oxide (MgO) and is stirred. The stirred reaction mixture is heated to reflux temperature. A Dean-Stark trap is placed between the flask and the reflux condenser, and water is removed until the pot temperature is 100° C. The stirred reaction mixture is cooled, and 8400 grams of light mineral oil (75 sec. solvent extracted naphthenic oil - Telura® 415 - Exxon Company, U.S.A. - Houston, Tex.) is added. The stirred reaction mixture is heated to 150° C. under vacuum to strip the heptane, and the resultant clear concentrate is filtered. The reaction product (NA-SUL®MG - King Industries) is analyzed by hyamine titration and is found to contain 50.28 percent magnesium sulfonate.

EXAMPLE 1

A blend is prepared by dissolving 2.2 grams of the product prepared by the method of Procedure A (0.89 grams of zinc dinonylnaphthalene sulfonate and 1.33 grams of 4 cSt synthetic hydrocarbon base fluid (polyalphaolefin mixture - Emery® 3004 PAO - Quantum Chemical Corp. (NA-SUL®ZS - King Industries)) and 0.56 grams of primary antioxidant (4,4'-dioctyldiphenylamine - Vanlube® 81 - R.T. Vanderbilt Co. - Norwalk, Conn.) in 217.2 grams of solvent refined heavy paraffinic distillate (petroleum - Sunpar® LW110 - Sun Refining and Marketing Company - Philadelphia, Pa.). 200 ml of the blend are placed in a test cell which is then exposed to a temperature of 150° C. under ASTM D4636-86 conditions. The initial blend is a light tan mobile liquid with an acid value of 0.64 mg KOH/g and a kinematic viscosity at 40° C. of 20.87 cSt. The induction period lasts through 185 hours. After 185 hours of exposure, the sample turns to a brown clear mobile liquid, has an acid value of 0.78 mg KOH/g and has a viscosity at 40° C. of 20.94 cSt.

COMPARATIVE EXAMPLE 1A*

200 ml of solvent refined heavy paraffinic distillate (petroleum - Sunpar® LW110 - Sun Refining) are placed in a test cell which is then exposed to a temperature of 150° C. under ASTM D4636-86 conditions. The initial sample is a colorless liquid with an initial acid value 0.16 mg KOH/g and kinematic viscosity at 40° C. of 20.67 cSt. After 16 hours, the sample turns orange, has an acid value of 3.67 mg KOH/g and has a viscosity at 40° C. of 27.30 cSt.

COMPARATIVE EXAMPLE 1B*

A blend is prepared by mixing 200 ml of solvent refined heavy paraffinic distillate (petroleum - Sunpar® LW110 - Sun Refining) and 0.3793 gram of primary antioxidant (4,4'-dioctyldiphenylamine - Vanlube® 81 - R.T. Vanderbilt Co.). 200 ml of the blend are placed in a test cell which is then exposed to a temperature of 150° C. under ASTM D4636-86 conditions. The initial blend is a nearly colorless mobile liquid with an acid value of 0.14 mg KOH/g and a kinematic viscosity at 40° C. of 20.83 cSt. The induction period is 8 hours. After 16 hours, the acid value is 2.97 mg KOH/g, and the viscosity at 40° C. is 25.92 cSt.

COMPARATIVE EXAMPLE 1C*

A blend is prepared by mixing 200 ml of solvent refined heavy paraffinic distillate (petroleum - Sunpar® LW110 - Sun Refining and Marketing Company) and 0.4169 gram of primary antioxidant (methylene bis-4,4'-2,6-di-t-butyl phenyl - Ethanox® 702 - Ethyl Corp. - Baton Rouge, La.). 200 ml of the blend are placed in a test cell which is then exposed to a temperature of 150° C. under ASTM D4636-86 conditions. The initial blend is a nearly colorless mobile liquid with an acid value of 0.16 mg KOH/g and a kinematic viscosity at 40° C. of 20.7 cSt. The induction period is 83 hours. After 185 hours of exposure, the acid value is 23.39 mg KOH/g, and the viscosity at 40° C. is 119.77 cSt.

EXAMPLE 2

A blend is prepared by dissolving 2.2 grams of the product prepared by the method of Procedure B (1.11 grams of magnesium dinonylnaphthalene sulfonate and 1.09 grams of light mineral oil (75 solvent extracted naphthenic oil - Telura® 415 - Exxon Company, U.S.A.), (NA-SUL®MG King Industries) and 0.55 grams of primary antioxidant (4,4'-dioctyldiphenylamine Vanlube® 81 - R.T. Vanderbilt Co.) in 217.2 grams of solvent refined heavy paraffinic distillate (petroleum - Sunpar® LW110 - Sun Refining Marketing Company). 200 ml of the blend are placed in a test cell which is then exposed to a temperature of 150° C. under ASTM D4636-86 conditions. The initial blend is a light tan mobile liquid with an acid value of 0.21 mg KOH/g and a kinematic viscosity at 40° C. of 21.30 cSt. The induction period lasts through 185 hours. After 185 hours of exposure, the sample turns to a brown clear liquid, has an acid value of 0.71 mg KOH/g, and has a viscosity of 21.07 cSt.

EXAMPLE 3

A blend is prepared by dissolving 1.0754 grams of a 50 percent active solution of calcium dinonylnaphthalene sulfonate in light mineral oil (NA-SUL® 729 - King Industries) in 99.02 grams of a base fluid which is prepared by dissolving 3.5 grams of primary antioxidant (1.76 grams of an alkylated diphenylamine - Irganox® L57 - Ciba Geigy Corp. - Hawthorne, N.Y. blended with 1.74 grams of a t-butyl phenol derivative - Irganox® L130 - Ciba Geigy Corp.) in 696.41 grams of a severely hydrotreated heavy naphthenic distillate (Sunthene® 108 - Sun Refining). 52.04 grams of the resultant blend are placed in a test cell which is then exposed to a temperature of 150° C. under modified IP48 test conditions. The initial sample is a clear light tan mobile liquid with an acid value of 0.16 mg KOH/g. After 24 hours of exposure, the resultant blend is a clear bright mobile liquid with an acid value of 0.31 mg KOH/g.

COMPARATIVE EXAMPLE 3A*

A base fluid is prepared by dissolving 3.03 grams of primary antioxidant (1.50 grams of alkylated diphenylamine - Irganox® L57 - Ciba Geigy blended with 1.53 grams of a t-butyl phenol derivative - Irganox® L130 - Ciba Geigy Corp.) in 597.0 grams of a severely hydrotreated heavy naphthenic distillate (Sunthene® 108 - Sun Refining and Marketing Company). 52.06 grams of the base fluid are placed in a test cell which is then exposed to a temperature of 50° C. under modified IP48 test conditions. The initial sample is a nearly colorless, clear mobile liquid with an acid value of 0.18 mg KOH/g. After 24 hours of exposure, the sample turns to a dark liquid with a layer of black sludge approximately 5 mm thick and an acid value of 5.92 mg KOH/g.

EXAMPLE 4

A stock solution is prepared by dissolving 12.53 grams of a 39.19 percent solution of zinc dinonylnaphthalene sulfonate in 4 cs synthetic hydrocarbon fluid (polyalphaolefin mixture - Emery® 3004 PAO - Quantum Chemical Corp. in 1240 grams of 4 cSt synthetic hydrocarbon base fluid (polyalphaolefin mixture - Emery® 3004 PAO). A blend of 3.44 grams of primary antioxidant (alkylated phenyl-alpha-naphthylamine-Irganox® L06 - Ciba Geigy Corp.) dissolved in 1033 grams of the stock solution is prepared. 200 ml of the blend are placed in a test cell which is then exposed to a temperature of 175° C. under ASTM D4636-86 conditions. The initial sample is a light tan mobile liquid with an acid value of 0.48 mg KOH/g and a kinematic viscosity a 40° C. of 17.13 cSt. The induction period lasts over 88 hours. After 88 hours of exposure, the acid value is 0.51 mg KOH/g, and the viscosity at 40° C. is 17.37 cSt.

COMPARATIVE EXAMPLE 4A*

200 ml of 4 cSt synthetic hydrocarbon base fluid (polyalphaolefin mixture - Emery® 3004 PAO -Quantum Chemical Corp. are placed in a test cell which is then exposed to a temperature of 175° C. under ASTM D4636-86 conditions. There is no induction period. After 87 hours of exposure, the actual increase in acid value is 7.68 mg KOH/g, and the viscosity at 40° C. increases 261.3 percent.

COMPARATIVE EXAMPLE 4B*

A blend of 0.5530 gram of primary antioxidant (an alkylated phenyl-alpha-naphthylamine - Irganox® L06 - Ciba Geigy Corp.) dissolved in 219.51 grams of 4 cSt synthetic hydrocarbon base fluid (polyalphaolefin mixture - Emery® 3004 PAO - Quantum Chemical Corp. is prepared. 200 ml of the blend are placed in a test cell which is then exposed to a temperature of 175° C. under ASTM D4636-86 conditions. The initial blend has an acid value of 0.17 mg KOH/g and a kinematic viscosity at 40° C. of 16.96 cSt. The induction period lasts less than 40 hours. After 89 hours of exposure, the acid value is 5.6 mg KOH/g, and the viscosity at 40° C. in 30.07 cSt.

COMPARATIVE EXAMPLE 4C*

A blend of 0.25 percent by weight of primary antioxidant (1:1 wt ratio blend of an alkylated diphenylamine - Irganox® L57 - Ciba Geigy Corp. and a sulfur containing hindered bisphenol - Irganox® L115 - Ciba Geigy Corp.) and 99.75 percent by weight of 4 cs synthetic hydrocarbon base fluid (polyalphaolefin mixture - Emery® 3004 PAO - Quantum Chemical Corp. is prepared. 200 ml of the blend are placed in a test cell which is then exposed to a temperature of 175° C. under ASTM D4636-86 conditions. The induction period lasts 70 hours. After 166 hours of exposure, the actual increase in acid value is 8.36 mg KOH/g, and the viscosity at 40° C. increases 78.1 percent.

COMPARATIVE EXAMPLE 4D*

A blend of 0.25 percent by weight of primary antioxidant (a t-butyl phenol derivative - Irganox® L130 Ciba Geigy Corp.) and 99.75 percent by weight of 4 cSt synthetic hydrocarbon base fluid (polyalphaolefin mixture - Emery® 3004 PAO -Quantum Chemical Corp. is prepared. 200 ml of the blend are placed in a test cell which is then exposed to a temperature of 175° C. under ASTM D4638-86 conditions. The induction period lasts 26 hours. After 88 hours, the actual increase in acid value is 5.61 mg KOH/g, and the viscosity at 40° C. increases 95.9 percent.

COMPARATIVE EXAMPLE 4E*

A blend of 0.25 percent by weight of primary antioxidant (alkylated phenyl-alpha-naphthylamine - Irganox® L06 - Ciba Geigy Corp.) and 99.75 percent by weight of 4 cSt synthetic hydrocarbon base fluid (polyalphaolefin mixture - Emery® 3004 PAO - Quantum Chemical Corp. is prepared. 200 ml of the blend are placed in a test cell which is then exposed to a temperature of 175° C. under ASTM D4638-86 conditions. The induction period is 28 hours. After 88 hours of exposure, the actual increase in acid value is 5.47 mg KOH/g, and the viscosity at 40° C. increases 77.3 percent.

EXAMPLE 4F*

A blend of 0.25 percent by weight of primary antioxidant (phenyl-alpha-naphthylamine - PANA - Aldrich Chemical Company - Milwaukee, Wis. - recrystallized) and 99.75 percent by weight of 4 cSt synthetic hydrocarbon base fluid (polyalphaolefin mixture - Emery® 3004 PAO - Quantum Chemical Corp. is prepared. 200 ml of the blend are placed in a test cell which is then exposed to a temperature of 175° C. under ASTM D4636-86 conditions. The induction period lasts 48 hours. After 88 hours of exposure, the actual increase in acid value is 4.27 mg KOH/g, and the viscosity at 40° C. increases 53.8 percent.

COMPARATIVE EXAMPLE 4G*

A blend of 0.25 percent by weight of primary antioxidant (4,4'-dioctyldiphenylamine - Vanlube® 81 - R.T. Vanderbilt Co.) and 99.75 percent by weight of 4 cSt synthetic hydrocarbon base fluid (polyalphaolefin mixture - Emery® 3004 PAO -Quantum Chemical Corp. is prepared. 200 ml of the blend are placed in a test cell which is then exposed to a temperature of 175° C. under ASTM D4636-86 condition. There is no induction period. After 88 hours of exposure, the actual increase in acid value is 6.21, and the viscosity at 40° C. increases 121.1 percent.

EXAMPLE 5

A blend of 2.2010 grams of a 39.19 percent solution of zinc dinonylnaphthalene sulfonate in 4 cSt synthetic hydrocarbon base fluid (polyalphaolefin mixture - Emery® 3004 PAO - Quantum Chemical Corp. 0.5623 gram of primary antioxidant (alkylated phenyl-alpha-naphthylamine Irganox® L06 - Ciba Geigy Corp.), 0.5547 gram of secondary antioxidant (zinc diamyldithiocarbamate, 50 percent active in oil - Vanlube® AZ - R.T. Vanderbilt Co.) dissolved in 216.7 grams of 4 cs synthetic hydrocarbon base fluid (polyalphaolefin mixture - Synfluid® PAO 3004 Emery) is prepared. 200 ml of the blend are placed in a test cell which is then exposed to a temperature of 175° C. under ASTM D4636-86 conditions. The initial blend is a light tan mobile liquid with an acid value of 0.64 mg KOH/g and a kinematic viscosity at 40° C. of 17.14 cSt. The induction period lasts over 88 hours. After 88 hours of exposure, the acid value is 0.67 mg KOH/g, and the viscosity at 40° C. is 17.47 cSt.

Examples 1, 2, 3 and 4 demonstrate the synergistic effect components (B)(i) and (B)(ii) have on thermooxidative stability of normally thermooxidatively unstable natural and synthetic organic compounds. When compared with Comparative Examples 1A*, 1B*, 1C*, 3A* and 4A*-4G*, they demonstrate that primary antioxidants alone will not impart the thermooxidative stability that the synergistic effect of primary antioxidant and oil soluble barium, calcium, magnesium or zinc sulfonates impart to normally thermooxidatively unstable organic compounds.

Example 5 illustrates the further synergism that secondary antioxidants impart.

The above-mentioned patents and test methods are incorporated herein by reference.

Many variations will suggest themselves to those skilled in the art in light of the above detailed description. For example, instead of dinonylnaphthalene sulfonate, alkylbenzene sulfonate or petroleum sulfonate in component (B)(i), other sulfonates can be used, such as octyl, decyl, undecyl, dodecyl and the like. Likewise sulfonated diphenylalkanes can be used. Obviously, instead of diacids, the corresponding anhydrides and half esters can be used. Instead of mineral oil and polyalphaolefin as component (B)(iv), other carriers such as microcrystalline waxes, dioctyl adipate, silicone oils, and the like, can be substituted. Other conventional additives can be added in conventional amounts, such as extreme pressure additives, dispersants and the like. All such obvious variations are within full intended scope of the appended claims.

We claim:

1. A composition consisting essentially of:
(A) an organic compound which is thermooxidatively unstable at temperatures greater than 150° C.; and
(B) a thermooxidative stabilizing composition to thermooxidatively stabilize said organic compound at temperature greater than 150° C. consisting essentially of:
(i) an oil soluble sulfonate of a metal selected from barium, calcium, magnesium, zinc or a mixture of any of the foregoing;
(ii) at least one primary antioxidant comprising a phenolic antioxidant, an aromatic amine antioxidant or a combination of the foregoing;
(iii) an optional secondary antioxidant comprising a thiocarbamate, a thioester or a combination of the foregoing; and
(iv) an optional carrier, which may be the same as or different than said organic compound, for said thermooxidative stabilizing composition.

2. A composition as defined in claim 1 wherein component (A) is selected from the group consisting of a wax; an ester; a hydrocarbon fluid; a halocarbon fluid; a polyalphaolefin; a polyglycol; a mineral oil; a thermoplastic polymer; a thermosetting polymer; a copolymer of an olefin and a non-olefin; or a mixture of any of the foregoing.

3. A composition as defined in claim 1 wherein component (B)(i) comprises an oil soluble barium, calcium, magnesium, or zinc salt of an alkylarylsulfonic or petroleum sulfonic acid having a molecular weight above about 325.

4. A composition as defined in claim 3 wherein component (B)(i) comprises a barium, calcium, magnesium or zinc salt of a dialkylarylsulfonic acid.

5. A composition as defined in claim 4 wherein component (B)(i) comprises a barium, calcium, magnesium, or zinc salt of dinonylnaphthalene sulfonic acid.

6. A composition as defined in claim 1 wherein component (B)(i) is selected from the group consisting of barium dinonylnaphthalene sulfonate, calcium dinonylnaphthalene sulfonate, magnesium dinonlynaphthalene sulfonate, zinc dinonylnaphthalene sulfonate, barium alkylbenzene sulfonate, calcium alkylbenzene sulfonate, magnesium alkylbenzene sulfonate, zinc alkylbenzene sulfonate, or a mixture of any of the foregoing.

7. A composition as defined in claim 1 wherein component (B)(ii) is selected from the group consisting of methylene bis-4,4'-2,6-di-t-butyl phenol, 4,4'-dioctyldiphenylamine, alkylated phenyl-alpha-naphthlamine, t-butyl phenol derivatives, alkylated diphenylamines, phenyl-alphanaphthylamine, sulfur containing hindered bisphenols, or a mixture of any of the foregoing.

8. A composition as defined in claim 1 wherein component (B)(iii) comprises zinc diamyldithiocarbamate.

9. A composition as defined in claim 1 wherein component (B)(iv) is selected from the group consisting of waxes, esters, halocarbon fluids, polyalphaolefins, polyglycols, mineral oils, or mixtures of any of the foregoing.

10. A composition as defined in claim 1 wherein component (A) comprises from about 95 to about 99.95 percent by weight and component (B) comprises from about 5 to about 0.05 percent by weight of (A) and (B) combined.

11. A composition as defined in claim 1 wherein component (B)(i) comprises from about 2 to about 20 percent by weight; component (B)(ii) comprises from about 40 to about 90 percent by weight; component (B)(iii) comprises from zero to about 50 percent by weight; and component (B)(iv) comprises from zero to about 30 percent by weight of (B)(i), (B)(ii), (B)(iii) and (B)(iv) combined.

12. A method for stabilizing an organic compound which is thermooxidatively unstable at temperatures greater than 150° C. comprising blending with said compound, a thermooxidative stabilizing composition to thermooxidatively stabilize said organic compound at temperatures greater than 150° C. consisting essentially of:

(i) an oil soluble sulfonate of a metal selected from barium, calcium, magnesium, zinc or a mixture of any of the foregoing;

(ii) at least one primary antioxidant comprising a phenolic antioxidant, an aromatic amine antioxidant or a combination of the foregoing;

(iii) an optional secondary antioxidant comprising a thiocarbamate, a thioester or a combination of the foregoing; and (iv) an optional carrier which may be the same as or different than said organic compound for said thermooxidative stabilizing composition.

13. A thermooxidative stabilizing composition to thermooxidatively stabilize an organic compound which is thermooxidatively unstable at temperatures greater than 150° C. consisting essentially of (i) an oil soluble sulfonate of a metal selected from barium, calcium, magnesium, zinc or a mixture of any of the foregoing;

(ii) at least one primary antioxidant comprising a phenolic antioxidant, an aromatic amine antioxidant or a combination of the foregoing;

(iii) an optional secondary antioxidant comprising a thiocarbamate, a thioester or a combination of the foregoing; and (iv) an optional carrier, which may be the same as or different than said organic compound, for said thermooxidative stabilizing composition.

* * * * *